US009772166B2

(12) United States Patent
Shelton

(10) Patent No.: US 9,772,166 B2
(45) Date of Patent: Sep. 26, 2017

(54) VENTILATION SYSTEM FOR BALLISTIC VESTS AND RELATED METHODS OF CREATING A COOLING BARRIER BETWEEN A BODY AND A BALLISTIC VEST

(71) Applicant: Jeff Shelton, Van Nuys, CA (US)

(72) Inventor: Jeff Shelton, Van Nuys, CA (US)

( * ) Notice: Subject to any disclaimer, the term of this patent is extended or adjusted under 35 U.S.C. 154(b) by 84 days.

(21) Appl. No.: 14/418,407

(22) PCT Filed: Nov. 24, 2014

(86) PCT No.: PCT/US2014/067166

§ 371 (c)(1),
(2) Date: Jan. 29, 2015

(87) PCT Pub. No.: WO2015/088763

PCT Pub. Date: Jun. 18, 2015

(65) Prior Publication Data

US 2016/0273881 A1 Sep. 22, 2016

Related U.S. Application Data

(60) Provisional application No. 61/914,534, filed on Dec. 11, 2013.

(51) Int. Cl.
*A41D 27/28* (2006.01)
*F41H 1/02* (2006.01)

(52) U.S. Cl.
CPC ..... *F41H 1/02* (2013.01); *A41D 27/28* (2013.01)

(58) Field of Classification Search
CPC ..... F41H 1/02; A41D 27/28
See application file for complete search history.

(56) References Cited

U.S. PATENT DOCUMENTS 4,451,934 A * 6/1984 Gioello ..... A41B 9/00 2/113
4,575,097 A * 3/1986 Brannigan ..... A61F 7/02 607/108
6,363,527 B1 * 4/2002 Biermann ..... F41H 1/02 2/2.5
8,322,156 B2 * 12/2012 Searle ..... A41D 13/0025 62/259.3
8,495,767 B2 * 7/2013 Berglund ..... A41D 13/0053 128/202.12
8,756,718 B2 * 6/2014 Tymofy ..... A41B 9/06 2/113
9,204,674 B2 * 12/2015 Bujold ..... A41D 13/0025
9,339,066 B2 * 5/2016 Codner ..... A41D 13/0025

(Continued)

*Primary Examiner* — Richale Quinn
(74) *Attorney, Agent, or Firm* — Buche & Associates, P.C; John K. Buche; Bryce A. Johnson

(57) ABSTRACT

Disclosed are ventilation systems for a ballistic resistant vest and related methods of creating a cooling barrier between a wearer's body and a ballistic vest. In a preferred embodiment, the ventilation system may be defined by a panel that features vented grooves. In a preferred mode of use, the panel is preferably positioned between a vest and the torso of a wearer of the vest whereby a space is created therebetween the vest and wearer so that air may freely flow. Suitably, the tension of the vest against the body is sufficient to hold the panel in place between the body and the vest.

10 Claims, 6 Drawing Sheets

(56) References Cited

U.S. PATENT DOCUMENTS

| | | | | |
|---|---|---|---|---|
| 2005/0246826 | A1* | 11/2005 | McCarter | A41D 13/0053 2/458 |
| 2010/0319381 | A1* | 12/2010 | Hubler | A41D 13/0053 62/259.3 |
| 2012/0246788 | A1* | 10/2012 | Harrell | A41D 31/005 2/2.5 |
| 2014/0150154 | A1* | 6/2014 | Aquino | F41H 1/02 2/2.5 |

* cited by examiner

VENTILATION SYSTEM FOR BALLISTIC VESTS AND RELATED METHODS OF CREATING A COOLING BARRIER BETWEEN A BODY AND A BALLISTIC VEST

CROSS-REFERENCE TO RELATED APPLICATIONS

This application is a national stage application of PCT/US14/67166 filed on Nov. 24, 2014. That application claims the benefit and priority of U.S. Prov. Pat. App. Ser. No. 61/914,534 (filed Dec. 11, 2013) entitled "Simple ventilation system creating a cooling barrier between body and ballistic vests." Said PCT and provisional patent applications are hereby incorporated by reference in its entirety as if fully set forth herein.

STATEMENT REGARDING FEDERALLY SPONSORED RESEARCH OR DEVELOPMENT

Not applicable.

BACKGROUND OF THE INVENTION

Field of Invention

There are many millions of police officers in the United States and worldwide. These officers frequently encounter dangers that entail ballistic attacks. So that officers are protected in these situations, standard bullet-resistant vests (e.g., Kevlar® vests) are made available to every police officer.

Although readily available, police officers do not always wear ballistic-resistant vests in dangerous situations. One reason that the vests are not worn is that the standard ballistic-resistant vest can trap heat, which frequently results in life-threatening heat buildup within the vest. Life-threatening overheating due to heat-buildup by a ballistic-resistant vest is so frequent that an estimated one-half of the nearly one-million police officers in the United States do not wear their vests out of overheating fears. Even when the heat trapped by the vest is not life-threatening, it is uncomfortable for the wearer. Forgoing a vest to avoid overheating and discomfort is so common that police officers with no vest colloquially jest, "I'd rather die comfortably [from a ballistic attack than wear a vest and die from overheating]."

In view of the foregoing, a need exists for ventilation systems for ballistic resistant vest and related methods of creating a cooling barrier between a body and a ballistic vest. Some have attempted to meet this need with an undergarment or shirt that has sewn-in foam spacers which create ventilation spaces between the vest and wearer's torso. See, e.g., U.S. Pat. No. 8,756,718 (issued Jun. 24, 2014) and U.S. Pat. No. 4,451,934 (issued Jun. 5, 1984). However, sewn-in foam spacers are readily compressible and subject to failure so that heat venting spaces between the vest and wearer are often non-existent or kinked. Also, the foam can act as heat-trapping insulation that exacerbates the overheating problem. Furthermore, sewn in spacers have a tendency to bunch together and can, as a result, lead to discomfort or encumber the wearer's movement. Finally, foam spacers cannot contribute to the efficacy of a vest's ballistic-resistance. Thus, a need still exists for a ventilation system for a ballistic-resistant vest and related methods of creating a cooling barrier between a body and a ballistic-resistant vest.

SUMMARY OF THE INVENTION

Based on the foregoing, it is an object of this disclosure to describe ventilation systems for a ballistic resistant vest and related methods of creating a cooling barrier between a wearer's body and a ballistic-resistant vest. It is a further objective to describe vest cooling systems and related methods that do not readily fail or cause discomfort to a user. Finally, it is a primary objective of this disclosure to allow police officers to wear ballistic resistant vests without the fear of life-threatening or uncomfortable overheating.

In a preferred embodiment, the ventilation system may be defined by at least one panel of a flexible and semi-rigid plastic comprised of vented grooves. In one embodiment, the panel is roughly the size and shape of a panel of Kevlar® commonly used in under-uniform bullet-resistant vests. In one embodiment, the grooves of the panels features holes to permit the transmission of sweat therethrough. In one mode of use, the vented panels may be placed between the vest and undershirt of a wearer so that the grooves create a slight, but highly effective, separation of the vest and body. Suitably, the tension of the vest against the body is sufficient to hold the panel in place between the body and the vest. In a preferred embodiment, the separation of the vest from the wearer's body is approximately one-half inch. In one embodiment, the separation of the vest and wearer keeps the user dry and cool by allowing constant airflow. In another mode of use, the vented panel may be wiped-down with a cleaning device (e.g., a cloth) after use.

Other objectives and desires may become apparent to one of skill in the art after reading the below disclosure and viewing the associated figures. Also, these and other embodiments will become apparent from the drawings.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

In general, disclosed are ventilation systems for a ballistic resistant vest and related methods of creating a cooling barrier between a wearer's body and a ballistic resistant vest. In a preferred embodiment, the ventilation system may be defined by a panel that features vented grooves. In a preferred mode of use, the panel is preferably positioned between a vest and the torso of a wearer of the vest whereby a space is created therebetween the vest and wearer. When the space is created, air may freely flow through the space to cool the wearer. Suitably, the tension of the vest against the body is sufficient to hold the panel in place between the body and the vest. The more specific details of the disclosed system are described in connection with the figures.

Figure 1:
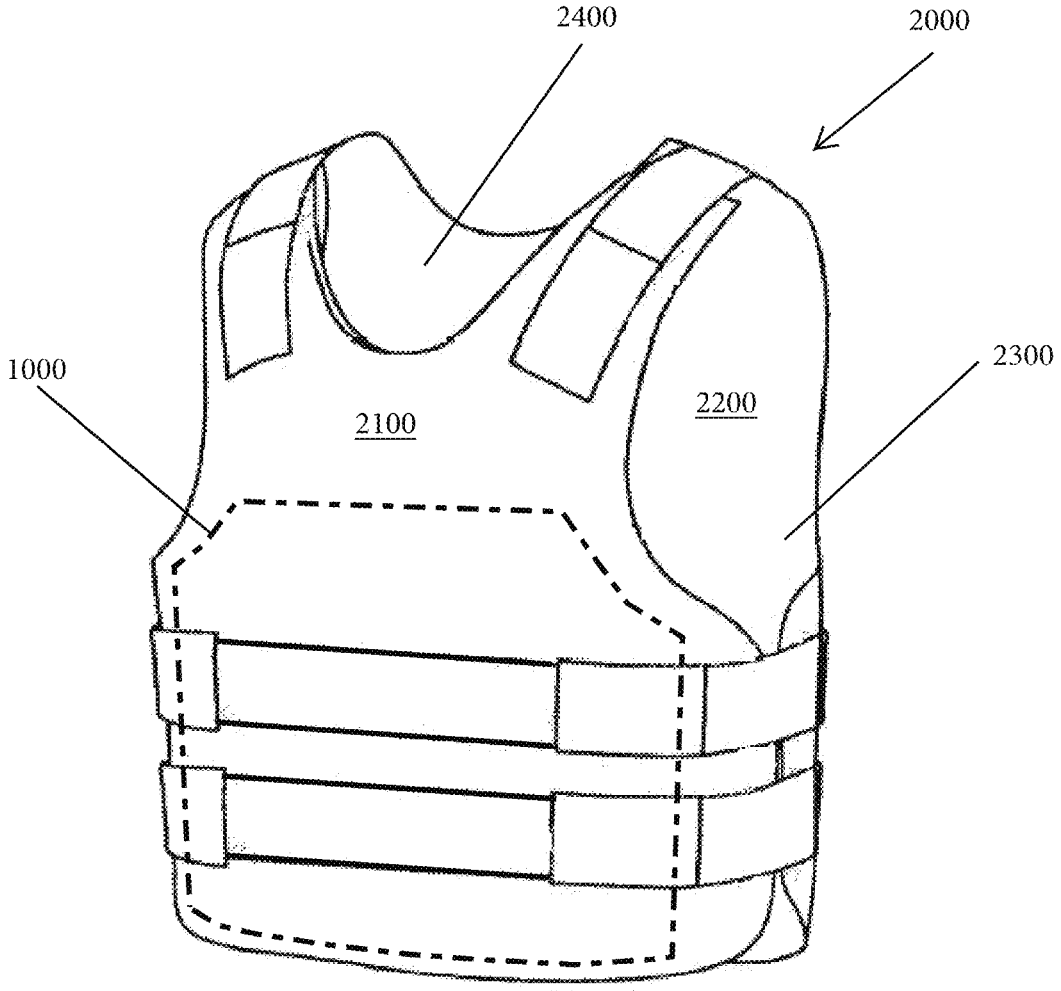
FIG. 1 is a perspective view of a ballistic resistant vest.

FIG. 1 is a perspective view of a ballistic resistant vest 2000. Generally, the vest 2000 features a front 2100, back 2200, arm holes 2300, and a neck hole 2400. As shown, the vest 2000 is preferably constructed in any manner or by any style known to those of skill in the art. Suitably, the vest 2000 may be worn over the torso (not shown) of a wearer in the manner known to those of skill in the art. As shown in broken lines, a panel 1000 may be preferably disposed behind the front 2100 of the vest 2000, between the vest 2000 and a wearer (not shown) when worn. Suitably, the tension of the vest 2000 against the body is sufficient to hold the panel 1000 in place between the wearer's body (not shown) and the vest 2000.

Figure 2:
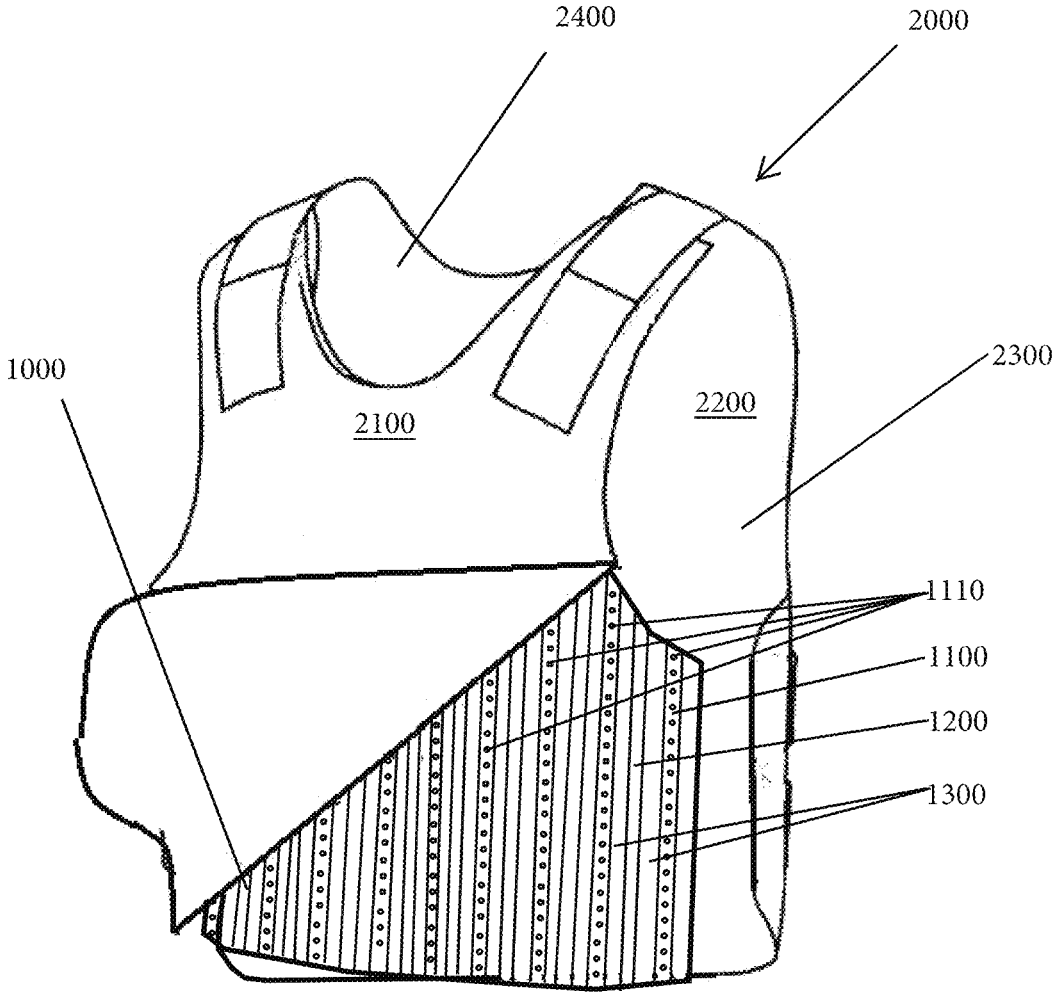
FIG. 2 is a perspective view of a ballistic resistant vest with the front partially turned over to expose a vented panel.

FIG. 2 is a perspective view of the ballistic resistant vest 2000 with the front 2100 partially upturned to expose the vented panel 1000. The figure is an environmental view that shows (a) the positioning of the panel 1000 when worn and (b) the features of the panel 1000. As shown, the panel 1000 may suitably be positioned between the front 2100 of the vest 2000 and a wearer (not shown). Still referring to FIG. 2, the panel 1000 is defined by an array of "valleys" 1100 and "peaks" 1200 with sidewalls 1300. In the figures, the valleys 1100 are positioned toward the wearer (not shown) while the peaks 1200 are positioned toward the vest 2000. When in use, the valleys 1100 abut the wearer (not shown) while the peaks 1200 abut the inside of the vest 2000 so that the sidewalls 1300 create a plurality of vent spaces between (a) the vest 2000 and panel 1000 and (b) the wearer (not shown) and panel 1000. In the depicted embodiment, the valleys 1100 features holes 1110 for allowing perspiration to pass therethrough when the same are abutted to a wearer's body (not shown).

Figure 3:
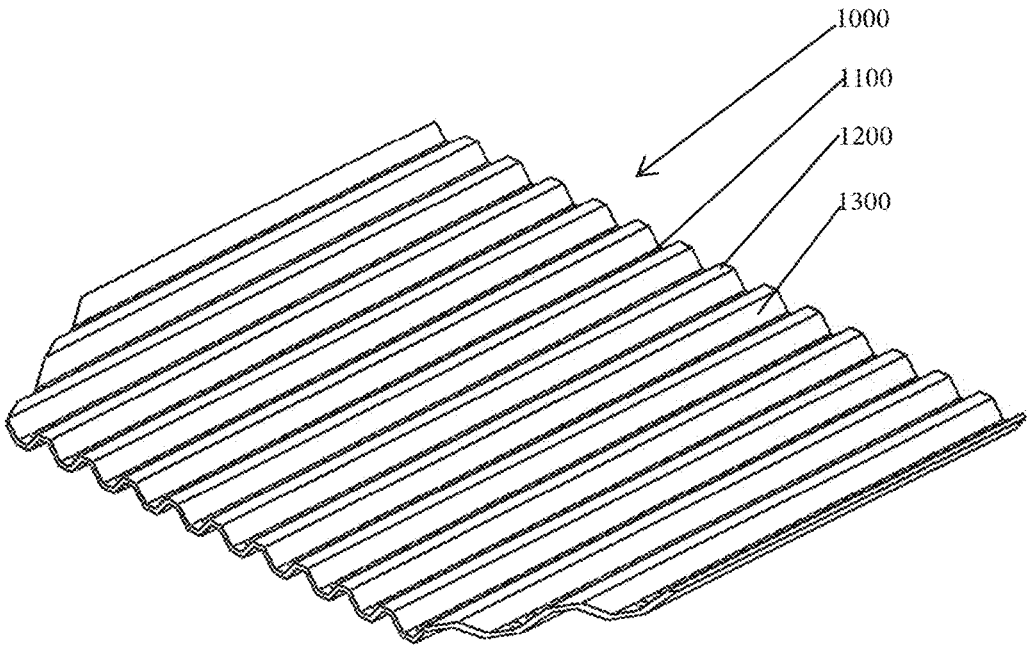
FIG. 3 is a perspective view of a vented panel.
Figure 4:
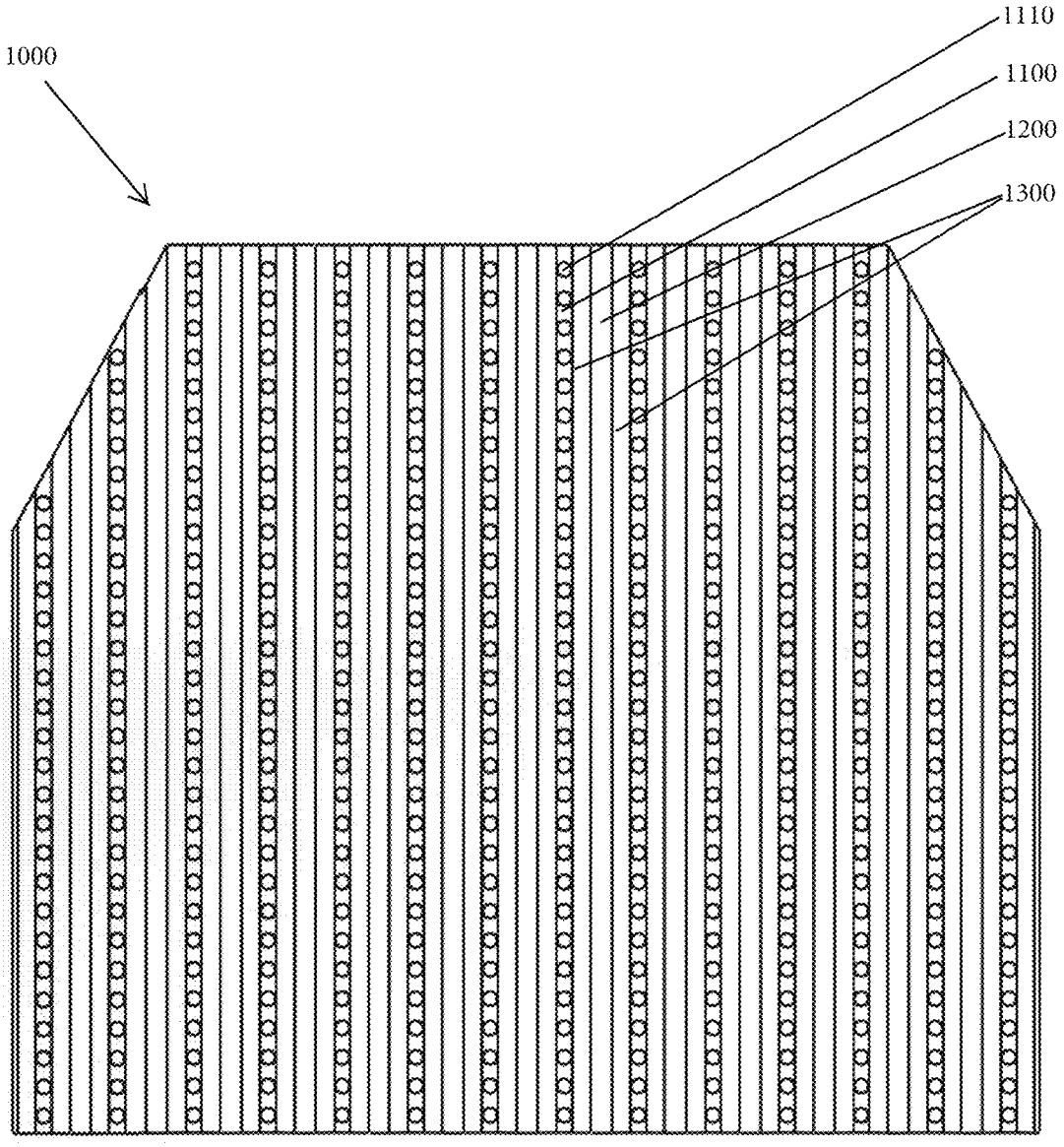
FIG. 4 is a front view of the vented panel of FIG. 3.
Figure 5:
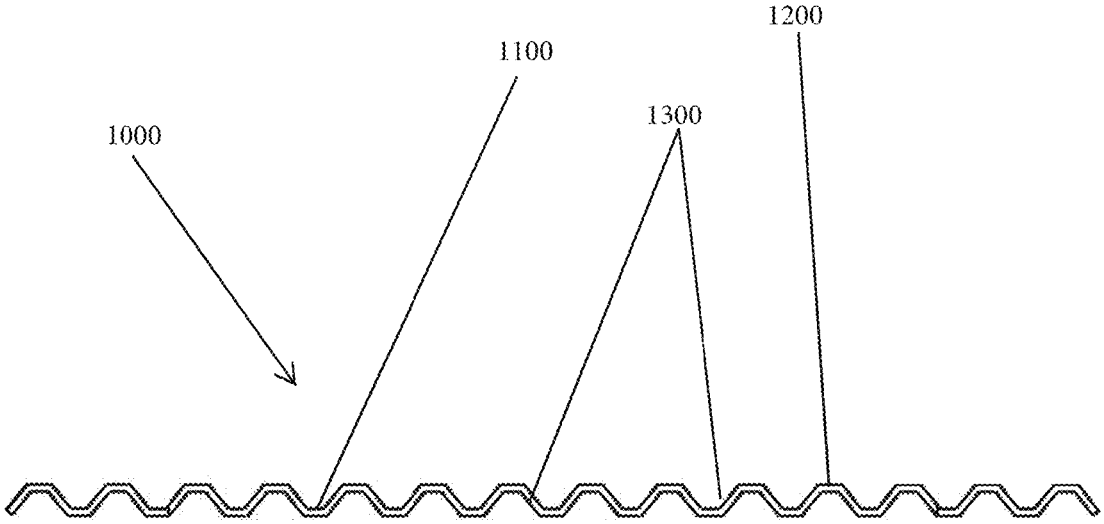
FIG. 5 is top view of the vented panel of FIG. 3.
Figure 6:
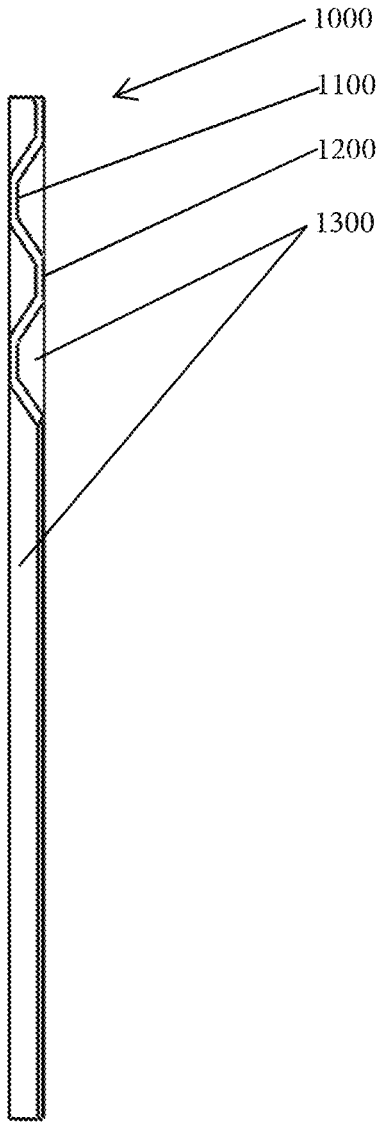
FIG. 6 is a right-side view of the vented panel of FIG. 3.

FIG. 3 is a perspective view of a vented panel 1000 shown in FIG. 2. FIG. 4 is a front view of the vented panel 1000 of FIG. 3. FIG. 5 is top view of the vented panel 1000 of FIGS. 3 and 4. FIG. 6 is a right-side view of the vented panel 1000 of FIGS. 3 through 5. Referring first to FIGS. 3 and 4, the panel 1000 is a hexagon sheet that is roughly the dimensions of a Kevlar® insert of known ballistic-resistant vests. As shown, the peaks 1200 and valleys 1100 run parallel to one another and alternate across the panel 1000. As discussed above, the valleys 1100 and peaks 1200 are separated by side walls 1300. This separation can be seen in FIG. 5. Suitably, the sidewalls separate the peaks 1200 and valleys 1100 by approximately a half inch, although greater or lesser separation may be provided without departing from the spirit and intent of this application. Finally, the panel may suitably be constructed of a flexible, semi-rigid plastic that may conform to the shape of a human torso when abutted thereto.

As alluded to above in connection with FIG. 2, the panel 1000 is configured to vent heat through the spaces between (a) the vest 2000 and panel 1000 and (b) the panel 100 and a wearer's body (not shown). Comparisons between an ordinary vest (not shown) and a vest 2000 worn in connection with a panel 1000 have been conducted. When the panel 1000 is worn with a vest 2000 on a treadmill for ten minutes with a four percent grade and operating at four miles an hour, the wearer's body temperature was six to eight degrees Fahrenheit lower than when an ordinary vest (not shown) is worn by itself. The average body temperature difference for users with and without a panel 1000 was seven degrees Fahrenheit.

In addition to venting heat, the panel 1000 also contributes to the efficacy of the vest's 2000 ballistic resistance. Suitably, the contribution to ballistic resistance is provided by the semi-rigidity of the panel 1000 and the spaces created between the vest and body of the wearer by the panel 1000. In a ballistic clay test, Winchester two hundred and thirty grain (full metal jacket) ammunition was fired from ten feet away at a muzzle velocity of eight hundred and thirty five feet per second at "Second Chance Level II" body armor positioned with and without the panel 1000 between the vest and potters clay (shaped into a fourteen inch by fourteen inch by two inch torso-like form around a fifty pound punching bag). Cratering damage from the ammunition in the clay was observed to be thirty percent less when a panel 1000 was used in connection with the vest 2000.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the Item in discussion, not an exhaustive or limiting list thereof, the terms "a" or "an" should be read as meaning "at least one," "one or more," or the like, and adjectives such as "conventional," "traditional," "normal," "standard,"

"known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims, as originally filed, are hereby incorporated by reference in their entirety.

I claim:

1. A ventilation system for a ballistic resistant vest comprising:

a panel with grooves that is positioned against an inside of the vest and that is adapted to be positioned against a torso of a wearer so that the panel is positioned between the inside of the vest and the torso of the wearer when worn;

wherein the grooves of the panel are defined by peaks and valleys separated by sidewalls;

wherein the peaks abut the inside of the vest to create at least a first plurality of vent spaces where each vent space in said first plurality of vent spaces is defined in a void between the vest, one of said valleys, and between two of said sidewalls; and, wherein at least a second plurality of vent spaces is formed whenever the valleys abut the torso of the wearer, where each vent space in said second plurality of vent spaces is defined in a void between the torso, one of said peaks, and between two of said sidewalls.

2. The ventilation system of claim 1 wherein the panel defines an irregular-hexagon in shape and where the peaks and valleys run parallel relative to one another across the panel so that heat is vented through said first plurality of vent spaces between the vest and panel.

3. The ventilation system of claim 2 wherein the separation of the peaks and valleys is one-half inch.

4. The ventilation system of claim 3 wherein the valleys feature perforations.

5. The ventilation system of claim 4 wherein the perforations of the valleys are holes.

6. A ventilation systems for a ballistic resistant vest comprising:

a panel that features vented grooves;

wherein the panel is adapted to be positioned between the ballistic resistant vest and the torso of a wearer of the vest so that (a) at least one space is created therebetween the vest and the torso and (b) air freely flows in the space;

wherein the panel is a hexagon sheet of a flexible, semi-rigid plastic that conforms to the shape of a human torso when abutted thereto;

wherein the panel features vents that are defined by peaks and valleys that are separated by side walls;

wherein the peaks and valleys are parallel and alternate across the panel;

wherein the panel features perforations.

7. The ventilation system of claim 6 wherein the perforations are holes.

8. A method of ventilating a ballistic resistant vest comprising the steps of:

a. obtaining a ballistic resistant vest that features a front, back, arm holes, and a neck hole;

b. placing the vest over the torso of a wearer;

c. placing a panel behind the front of the vest, between the vest and the wearer so that the tension of the vest against the torso is sufficient to hold the panel in place between the torso and the vest;

d. wherein the panel is defined by an array of valleys and peaks with sidewalls, wherein the peaks abut an inside of the vest to create at least a first plurality of vent spaces where each vent space in said first plurality of vent spaces is defined in a void between the vest, one of said valleys, and two of said sidewalls; and e. wherein the valleys abut the torso of the wearer to create at least a second plurality of vent spaces so that each vent space in said second plurality of vent spaces is defined in a void between the torso, one of said peaks, and between two of said sidewalls.

f. freely flowing air through said first and second plurality of vent spaces to cool the wearer.

9. The method of claim 8 wherein the panel is an irregular hexagon and the valleys are positioned toward the torso while the peaks are positioned toward the vest.

10. The method of claim 8 wherein the valleys features holes for allowing perspiration to pass therethrough when the same are abutted to the torso.

* * * * *